US006287145B1

(12) United States Patent
Goett

(10) Patent No.: US 6,287,145 B1
(45) Date of Patent: Sep. 11, 2001

(54) INTERNAL SHIELD SPLICE

(75) Inventor: Edward P. Goett, Healdsburg, CA (US)

(73) Assignee: Engineered Transitions Company, Inc., Santa Rosa, CA (US)

( * ) Notice: Subject to any disclaimer, the term of this patent is extended or adjusted under 35 U.S.C. 154(b) by 0 days.

(21) Appl. No.: 09/434,835

(22) Filed: Nov. 5, 1999

Related U.S. Application Data

(60) Provisional application No. 60/107,554, filed on Nov. 6, 1998.

(51) Int. Cl.[7] ..... H01R 9/05; H01R 13/648; H01R 4/66; H01R 9/03; H01R 13/58

(52) U.S. Cl. ..... 439/579; 439/98; 439/610; 439/464

(58) Field of Search ..... 439/579, 585, 439/98, 608, 609, 610, 447, 448, 463, 464

(56) References Cited

U.S. PATENT DOCUMENTS 5,716,236 * 2/1998 O'Sullivan et al. ..... 439/610
5,885,103 * 3/1999 Ernolf et al. ..... 439/579
6,007,370 * 12/1999 Langridge ..... 439/455

* cited by examiner

*Primary Examiner*—Paula Bradley
*Assistant Examiner*—Edwin A. Levin
(74) *Attorney, Agent, or Firm*—Johnson & Stainbrook, LLP; Larry D. Johnson; Craig M. Stainbrook

(57) ABSTRACT

A shield splice for terminating the individual shields on individual wires in multiple wire bundles includes a generally elongate section of transversely deformable material, preferably fabricated from aluminum or tin plated copper metal. The elongate section is open at each end and has a plurality of longitudinal passages which may be any of a number of geometrical shapes. The exterior surface is surrounded by a stainless steel or plastic tie strap, which may have a preinstalled ground strap. In use, wires with exposed shields are inserted through the passages in the elongate section, and the tie strap is cinched down and tightened, thus crushing the splice material around the individual wire shields and grounding them collectively. A method for grounding multiple internal braid splices is also disclosed.

11 Claims, 1 Drawing Sheet

INTERNAL SHIELD SPLICE

This application claims the benefit of U.S. Provisional Application Serial No. 60/107,554, filed Nov. 6, 1998.

BACKGROUND OF THE INVENTION

1. Field of the Invention

The present invention relates to an apparatus for electrically terminating shielded electrical wires, and more particularly to an internal braid splice for electrically terminating individual shields on multiple internal wires and which may be installed without the use of tools.

2. Description of the Prior Art

Shielded wire commonly comprises a plurality of concentric layers of material, usually including a metal conductor, an insulating tube or sleeve surrounding the conductor, a braided metal shield (or foil or other shielding material) wrapped around the insulting sleeve, and a second insulating layer surrounding the shield. The braided metal shield is often required: despite the layers protecting the conductive material, electronic equipment powered and controlled through such wires is often vulnerable to electromagnetic interference (EMI), which adversely affects the operation of the equipment. EMI can be generated by nearby electronic components or from electronic wires and cables connecting components to one another and to power sources.

It is well known that performance problems associated with EMI can be reduced by effectively terminating the shields to ground on power and data transmission cables. When multiple internal wires, or wire bundles, are spliced together to join cables or to connect cables to electronic components, it can be difficult and time consuming to terminate and ground each shield individually.

It is desirable, therefore, that a terminating apparatus be capable of collectively terminating the individual shields on multiple internal braided cables to one common ground, all without the need for using tools to accomplish the result.

SUMMARY OF THE INVENTION

The internal shield splice of this invention provides a means for electrically terminating the individual shields on multiple wires simultaneously, to one ground. The splice is easy and inexpensive to install and to manufacture. It is comprised of a generally elongate section or segment of transversely deformable material and is preferably fabricated from electrically conductive material such as aluminum or tin plated copper metal. The elongate section is open at each end and has a plurality of longitudinal passages which may be any of a number of geometrical shapes in cross section, including hexagonal (i.e., honeycomb), triangular, circular, square, and so forth. The splice has a generally regular, preferably generally circular, external configuration which is encased in a stainless steel or plastic tie strap or similar clamping article. After the wires (with their individual shields exposed) are inserted through the passages in the elongate section, with the exposed shields of the wires centered in the device, the tie strap is cinched down and tightened. This causes the splice material to crush and collapse around the individual wire shields and effectively grounds the shields together. A ground strap may be preinstalled in the splice to permit grounding of the device to any desired grounding plane (e.g., earth). The product can be further enhanced by attaching the splice to the rear of an adaptor using the steel tie strap.

DETAILED DESCRIPTION OF A PREFERRED EMBODIMENT

Figure 1:
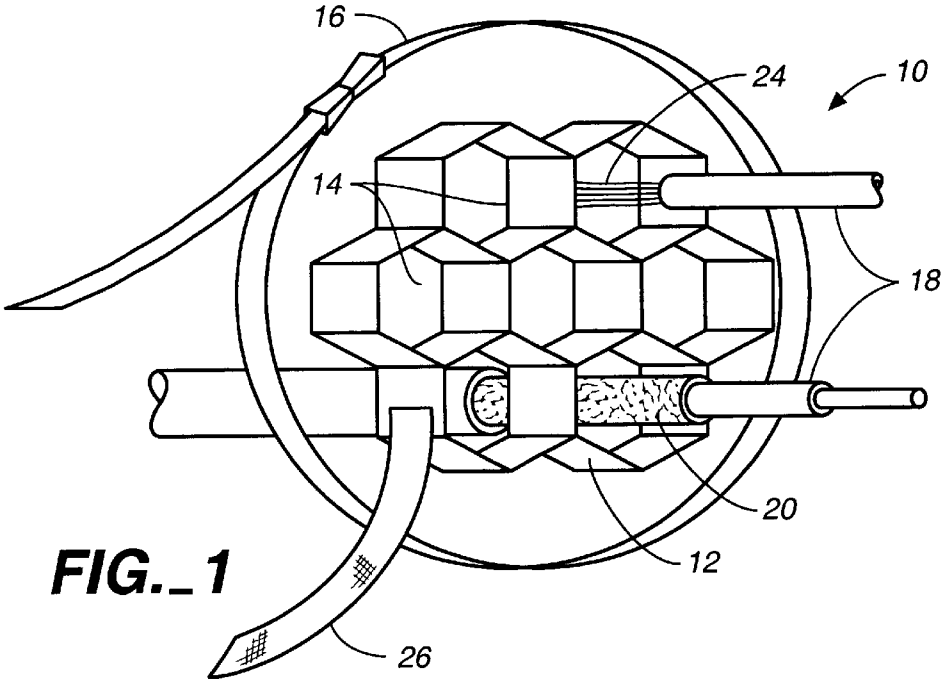
FIG. 1 is a perspective view of the shield splice of the present invention.
Figure 2B:
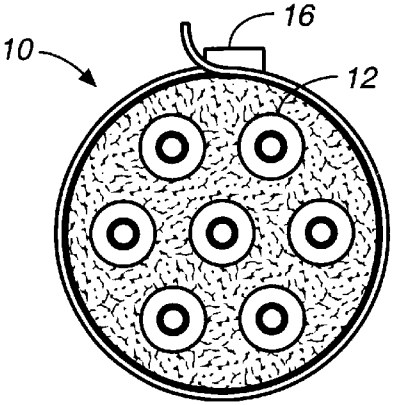
FIG. 2*b* is an end view of the shield splice.
Figure 2A:
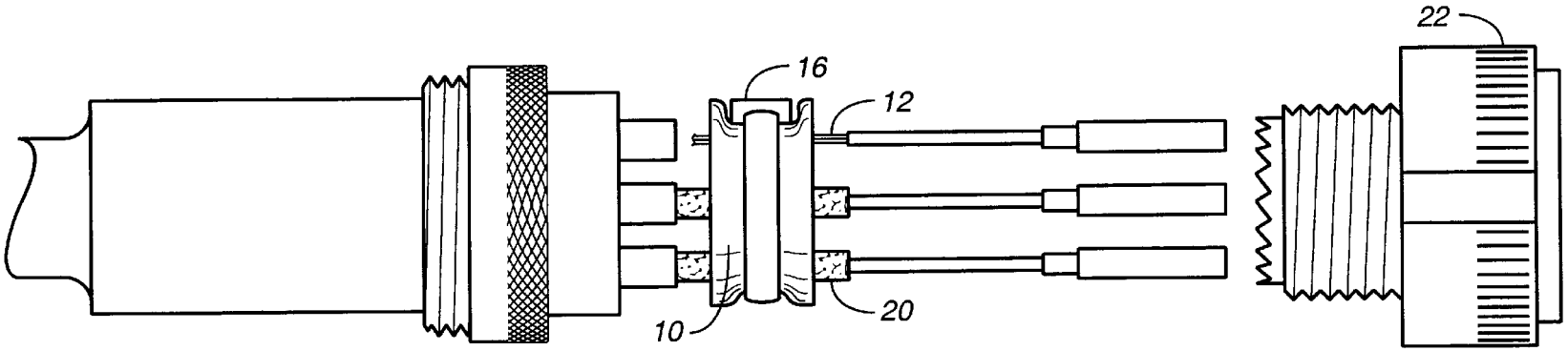
FIG. 2*a* is a side elevation view of the shield splice, shown in its environment.

FIG. 1 is a perspective view of the shield splice 10 of the present invention. The splice comprises a sleeve 12, preferably fabricated of very thin aluminum or tin plated copper metal. The material is easily deformable transversely so that it can be easily crushed or crumpled, but it is of high electrical conductivity and preferably high tensile strength. If the segment of sleeve is relatively short, it may have the configuration of a ring or ferrule. A longer sleeve segment may have a generally cylindrical configuration, as depicted in FIGS. 1 and 2*a*. The interior of the sleeve defines a plurality of passages 14, which may have any of a number of different geometrical shapes, including hexagonal (honeycomb shaped), triangular, square, or circular. FIG. 1 shows the splice having honeycomb apertures and an external configuration defined by the distal exterior exposed surfaces of the honeycombs. Viewed in cross section, the external surface of the splice is regular and substantially circular. Alternatively, the external configuration may be any of a number of suitable shapes without consequence to effectiveness or ease of application. Different shapes, thicknesses, and materials may provide different electrical grounding characteristics of the apparatus.

The exterior surface of the splice may be wrapped by a clamping element such as tie strap 16, preferably fabricated from plastic or stainless steel. In use, wires 18 are inserted through the apertures of the splice and the tie strap is cinched down and tightened. This crushes the splice around the wires, as shown in FIGS. 2 and 3, and effectively grounds the shields collectively. FIG. 2 shows that the braided shields 20 of connected wires may be exposed in the interior of the splice or, additionally or alternatively, wires originating from an electrical device connector 22 and having exposed ends 24 may be terminated in the splice.

A ground strap 26 may be preinstalled in the splice material to permit grounding of the device to a grounding plane, such as the earth.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. An apparatus for electrically terminating each of the individual wire shields of a plurality of shielded wires in a multiple wire bundle, said apparatus comprising:

a sleeve member having openings at each of two ends and a plurality of interior passages running longitudinally through said sleeve member from one end to the other, wherein said sleeve member crushes and deforms transversely and radially around the individual wire shields.

2. The apparatus of claim 1 wherein said sleeve member is fabricated of aluminum.

3. The apparatus of claim 1 wherein said sleeve member is fabricated of tin plated copper metal.

4. The apparatus of claim 1 wherein the interior passages of said sleeve are hexagonal in cross section.

5. The apparatus of claim 1 further comprising a ground strap connected to said sleeve member.

6. The apparatus of claim 1 further comprising a clamping member surrounding said sleeve member which, when tightened, crushes said sleeve member around wires inserted into the interior passages of said sleeve member.

7. An apparatus for electrically terminating the individual wire shields of a plurality of shielded wires in a multiple wire bundle, said apparatus comprising:

a sleeve member having openings at each of two ends and a plurality of interior passages running longitudinally through said sleeve member from one end to the other, said sleeve member being easily deformable transversely and having electrical conductivity;

a ground strap connected to said sleeve member for connection to a ground plane; and a tie strap surrounding said sleeve member which, when tightened, crushes said sleeve member around wires inserted into the interior passages of said sleeve member.

8. The apparatus of claim 7 wherein the interior passages of said sleeve are hexagonal in cross section.

9. An apparatus for electrically terminating each of the individual wire shields of a plurality of shielded wires in a multiple wire bundle, said apparatus comprising:

a sleeve member having openings at each of two ends and a plurality of interior passages running longitudinally through said sleeve member from one end to the other, wherein said sleeve member crushes and deforms transversely and radially around the individual wire shields; and a ground strap connected to said sleeve member.

10. The apparatus of claim 9 further comprising a clamping member surrounding said sleeve member which, when tightened, crushes said sleeve member around wires inserted into the interior passages of said sleeve member.

11. A method for electrically terminating the individual wire shields of a multiple wire bundle collectively, said method comprising the steps of:

providing a sleeve member having openings at each of two ends and a plurality of interior passages running longitudinally through said sleeve member from one end to the other, said sleeve member being fabricated from a material being easily deformable transversely and having high electrical conductivity;

providing a tie strap around said sleeve member;

providing a ground strap electrically connected to said sleeve member;

inserting the wires of a wire bundle into one end of said sleeve member and through the interior passages of said sleeve member so as to electrically connect to wires at the other end of said sleeve member, and leaving braided shield or conductive material of said wire exposed;

sliding said sleeve member over the electrical connections of said wires;

cinching down said tie strap so as to crush said sleeve member around said wires and to tightly hold said sleeve member in place relative to said wires; and connecting said ground strap to a ground plane.

* * * * *